US008646611B2

(12) United States Patent
Markovic

(10) Patent No.: US 8,646,611 B2
(45) Date of Patent: Feb. 11, 2014

(54) PIVOTAL PRODUCT PACKAGING

(75) Inventor: Nevenka Markovic, Nutley, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 13/380,442

(22) PCT Filed: Jun. 23, 2010

(86) PCT No.: PCT/US2010/039654

§ 371 (c)(1),
(2), (4) Date: Jan. 10, 2012

(87) PCT Pub. No.: WO2010/151588

PCT Pub. Date: Dec. 29, 2010

(65) Prior Publication Data

US 2012/0160727 A1 Jun. 28, 2012

Related U.S. Application Data

(60) Provisional application No. 61/269,324, filed on Jun. 23, 2009.

(51) Int. Cl.
*B65D 79/00* (2006.01)

(52) U.S. Cl.
USPC ..... 206/747; 206/461; 206/800; 220/822

(58) Field of Classification Search
USPC ..... 220/820, 822; 206/747, 748, 749, 750, 206/461, 800, 745, 528, 531, 532, 534.1, 206/538
See application file for complete search history.

(56) References Cited

U.S. PATENT DOCUMENTS

| | | | | |
|---|---|---|---|---|
| 1,992,630 | A * | 2/1935 | Piperoux | 206/743 |
| 5,099,995 | A | 3/1992 | Karakane et al. | |
| 5,813,740 | A | 9/1998 | Chang | |
| 6,318,550 | B1 | 11/2001 | Giovinazzi | |
| 7,093,736 | B2 * | 8/2006 | Maietta et al. | 221/3 |
| 7,464,819 | B2 | 12/2008 | Maietta | |
| 2006/0006091 | A1 * | 1/2006 | Maietta | 206/539 |
| 2007/0045150 | A1 * | 3/2007 | Huffer et al. | 206/538 |
| 2007/0138049 | A1 | 6/2007 | Bitner | |
| 2009/0139894 | A1 | 6/2009 | Bitner | |
| 2009/0218362 | A1 * | 9/2009 | Gelardi | 220/833 |
| 2009/0272659 | A1 * | 11/2009 | Kaiser et al. | 206/235 |

FOREIGN PATENT DOCUMENTS

| | | |
|---|---|---|
| JP | 1-161419 | 11/1989 |
| JP | 6-042750 | 6/1994 |
| JP | 8-000228 | 2/1996 |
| JP | 2002-274536 | 9/2002 |
| WO | WO2008/027436 A2 | 3/2008 |

OTHER PUBLICATIONS

Notice of Reasons for Rejection from corresponding JP Patent Application 2012-517687 to Kraft Foods Global Brands LLC filed Jun. 23, 2010 and translation.

* cited by examiner

*Primary Examiner* — Jacob K Ackun
(74) *Attorney, Agent, or Firm* — Hoffmann & Baron, LLP

(57) ABSTRACT

A blister package includes at least one blister tray having a plurality of open blister depressions each blister depression accommodating a consumable product. The blister sleeve includes a pair of spaced apart planar walls defining therebetween a pivot connection. The blister tray is received between the walls of the blister sleeve and pivotally coupled to the pivot location. The sleeves are pivotal from an enclosed position between the two planar walls to an open position outwardly of the planar walls.

20 Claims, 6 Drawing Sheets

PIVOTAL PRODUCT PACKAGING

This application claims the benefit of priority to U.S. Provisional Patent Application Ser. No. 61/269,324 filed on Jun. 23, 2009, the disclosure of which is incorporated by reference herein in its entirety for all purposes.

FIELD OF THE INVENTION

The present invention relates generally to packaging for containing and dispensing consumable products. More particularly, the present invention relates to a blister package having a blister tray which is pivotally supported in a blister sleeve for movement between an enclosed position and an open position.

BACKGROUND OF THE INVENTION

There exists in the prior art numerous packages which contain consumable products such as chewing gum pieces. One type of package is a blister package which includes a blister tray and blister sleeve. Many blister packages provide both aesthetic and functional features which make the package desirable to the consumer. Certain of the desirable features include an aesthetically designed packaging which permits viewing of the contents. Certain of the functional features include the ability to retain the gum pieces in the package which allow for convenient individual dispensing of the gum pieces.

It is desirable to provide improved gum packaging which, while maintaining the aesthetically pleasing appearance, provides superior functionality to the consumer.

SUMMARY OF THE INVENTION

The present invention provides a blister package including at least one blister tray having a plurality of upwardly opening blister depressions. Each blister depression accommodates a consumable product. The blister sleeve includes a pair of spaced apart planar walls defining therebetween a pivot connection. The blister tray is received between the walls of the blister sleeve and is pivotally coupled to the pivot connection. The sleeves are pivotal from an enclosed position between the two planar walls to an open position outwardly of the planar walls.

The present invention further provides a comestible product packaging including a sleeve having first and second spaced planar walls defining a sleeve interior. A first blister tray has a plurality of depressions for retaining a comestible product. The first blister tray is pivotally joined to the sleeve. The first blister tray has a first position wherein the depressions are disposed outside of the sleeve to permit dispensing of the comestible product, and a second position wherein the depressions are disposed within the sleeve interior.

DETAILED DESCRIPTION OF THE PREFERRED EMBODIMENT

The present invention provides a package for enclosing and dispensing a plurality of products, preferably consumable products. More particularly, the present invention is designed to contain and dispense confectionery products such as gum pieces. While multi-layered gum pieces are shown in the preferred embodiments of the present invention, it may be appreciated that the package disclosed herein may be used to dispense a wide variety of consumable products such as gum pieces in many forms. It is contemplated that the package of the present invention may be used to contain and dispense gum pieces in various shapes, including slabs, sticks, pellets, pillows and the like. In addition, unwrapped gum slabs are shown in the preferred embodiments herein and it is within the contemplation of the present invention that the individual gum pieces may be wrapped or unwrapped.

Figure 1:
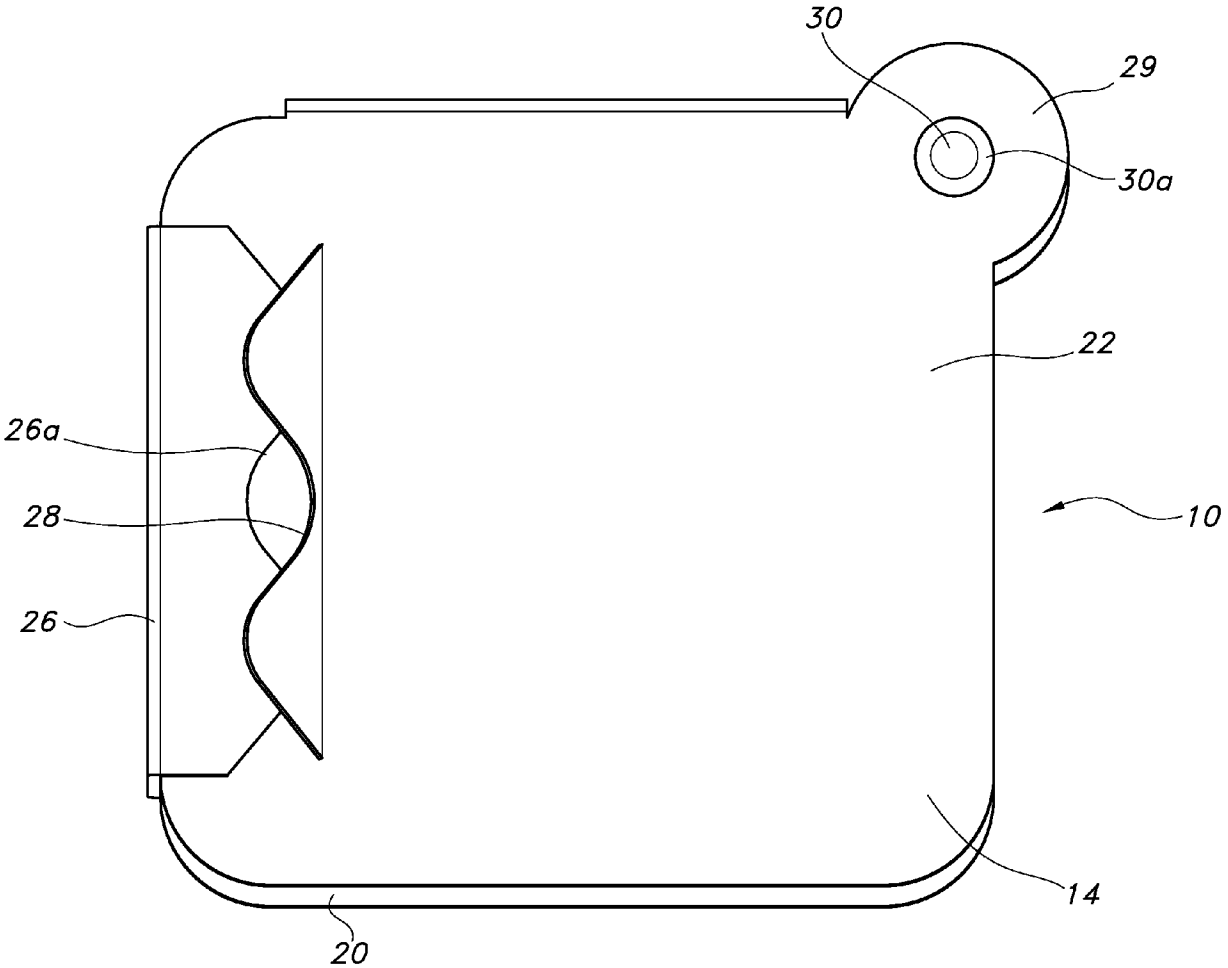
FIG. 1 is a top plan view of the blister package of the present invention shown in the closed position.
Figure 2:
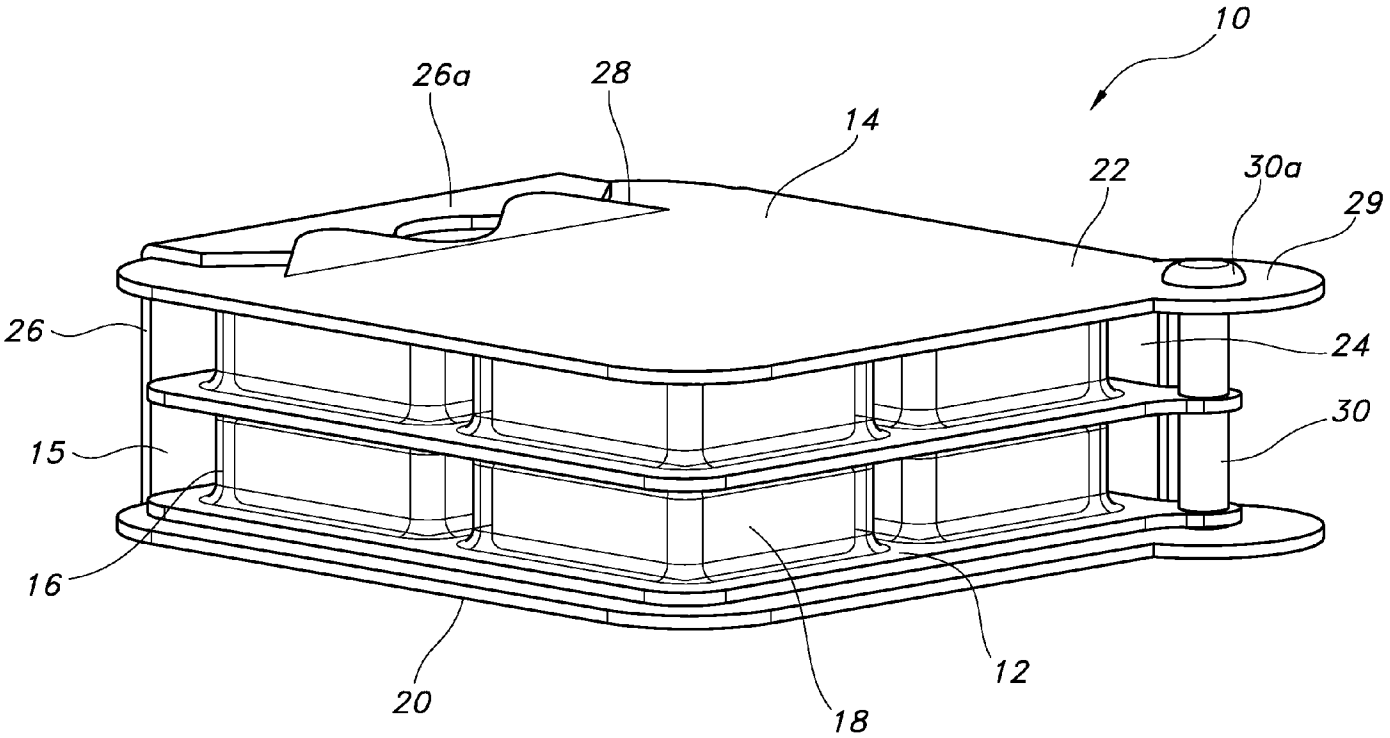
FIG. 2 is a side perspective view showing the blister package in the closed position.
Figure 3:
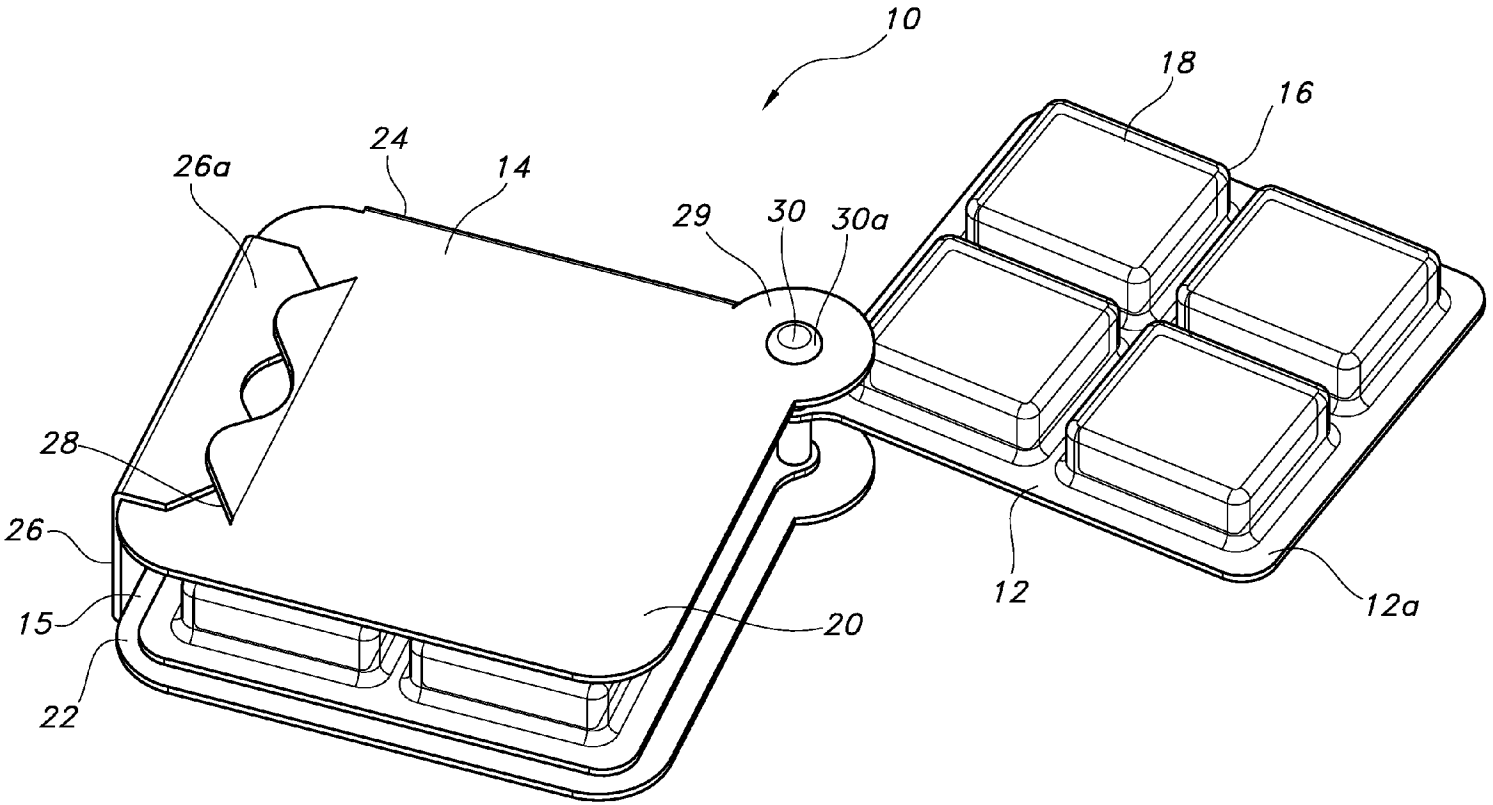
FIG. 3 is a top perspective view showing the blister package in an open position.

Referring to FIGS. 1-3, the package 10 includes a plurality of product holders 12 and a sleeve 14 for accommodating the product holders. The product holders may be blister trays 12 which are generally conventional transparent blister trays having an upwardly opening blister depression 16. In the present illustrative embodiment, each blister tray 12 includes four blister depressions 16 each of which accommodates a gum piece 18. The blister depressions 16 are deformable by a user to permit dispensing of the gum piece 18. It is within the contemplation of the present invention that the number of depressions 16 may be varied to accommodate a desired number of gum pieces. The gum pieces may all be the same, or they may be of different types, e.g., different flavors, colors, shapes, etc.

Figure 4A:
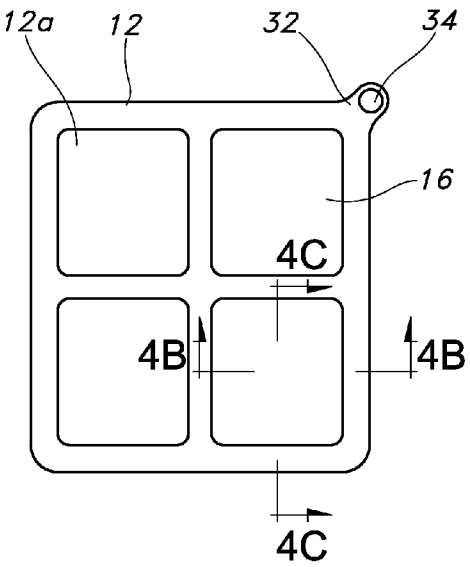
FIG. 4A is a top plan view of a blister tray.
Figure 4C:
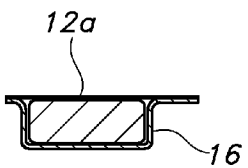
FIG. 4C is a cross-sectional view taken along line 4C-4C of FIG. 4A.
Figure 4B:
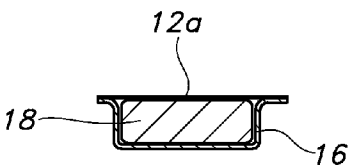
FIG. 4B is a cross-sectional view taken along line 4B-4B of FIG. 4A.

With further reference to FIGS. 4A-C, each blister tray 12 may also include a blister film or cover 12*a* which overlies the upwardly opening blister depressions 16. The cover 12*a* may be formed or a variety of materials such as a metallic foil or a transparent plastic film. A gum piece 18 may be removed by manually pushing on the blister depression 12 thereby urging the gum piece toward the cover 12*a* to rupture the cover, in a manner known in the art.

The blister sleeve 14 includes an interior 15 for receiving the blister tray 12 and providing protection therefor. The sleeve 14 includes two major planar walls 20 and 22 which are placed in spaced apart parallel orientation and are connected by a side wall 24 and a foldable end wall 26. The foldable end wall 26 extends from one planar wall 22 and includes a tab 26*a* which is insertable into a slot 28 in the other planar wall 20 to provide a partially enclosed sleeve. Two adjoining edges of the sleeve are open to allow the blister tray to be pivoted in and out of the sleeve. The other two adjoining edges may be covered by the side wall 24 and end wall 26 to help retain the blister tray in the sleeve. The planar walls 20 and 22 provide a surface upon which indicia regarding the product may be printed or otherwise applied.

While the blister trays 12 and sleeve 14 are shown to be generally rectangular, it is within the contemplation of the present invention that the shape of the trays and sleeve could be varied. For example, a round, oval or various polygon shapes could be chosen.

Figure 5:
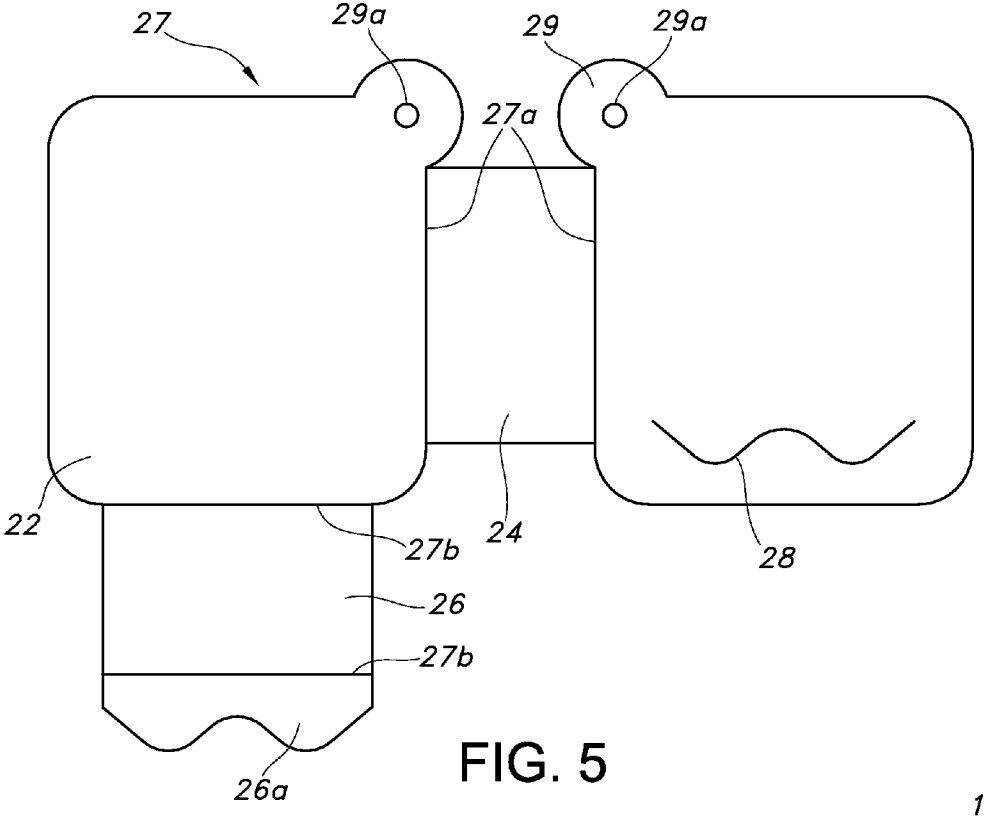
FIG. 5 is a plan view showing the die cut blank used to form the blister sleeve of FIG. 1.

As shown in FIG. 5, the sleeve 14 may be formed from a single, unitary, die cut flat blank 27 of paperboard or other known materials or combinations thereof. Planar wall 20 may be folded over planar wall 22 along fold lines 27*a*. The end wall 26 may then be folded along fold lines 27*b* with tab 26*a* being inserted into slot 28. Tab 26*a* may be retained in slot 28 by a mechanical interconnection between the slot and the tab 26*a*. Alternatively, other securement techniques, such as the use of adhesive, may also be employed.

Assembled as shown in FIGS. 1-3, the blister sleeve planar walls 20 and 22 each includes an extending lobe-shaped corner portion 29 having a hinge aperture 29*a* (FIG. 5) extending there through. The hinge apertures 29*a* are in opposed alignment to each other and a pivot pin 30 extends therebetween. The pivot pin may include a head 30*a* at each end which is larger than the apertures such that the pin is retained in the sleeve. Pivot pin 30 defines a pivot location for supporting the blister sleeves 14 in stacked orientation therein.

As particularly shown in FIG. 4A, each blister tray 12 includes an extending portion 32 projecting from a corner thereof and having an aperture 34 therein. The pivot pin 30 extends through the aperture 34 to pivotally retain the trays 12 to the sleeve. The trays may each be individually pivoted between an enclosed position and an open position. All the blister trays 12 can be at least partially removed from the sleeve 14 such they fan out. In the enclosed position, the trays are disposed within the sleeve interior and the depressions are covered by the walls 20 and 22. When a tray 12 is in the open position as shown in FIG. 3, the tray is disposed outside of the sleeve interior 15 and the blister tray depressions are not covered by the sleeve planar walls. In the enclosed position, the blister depressions, which project from one side of the blister tray, may press against the inside surface of blister sleeve walls 20 and 22 to frictionally retain the blister tray 12 in the sleeve 14.

Referring to FIGS. 2 and 3, use of the blister package of the present invention is shown. One of the blister trays 12 may be moved from the enclosed position as shown in FIG. 2 to an open position as shown in FIG. 3 by pivoting the blister tray 12 out from the blister sleeve 14. The gum pieces 18 may be dispensed in conventional fashion through rupturing the cover 12*a*. Thereafter, the blister tray 12 may be pivotally returned to its enclosed position within the sleeve interior. Each of the two spaced apart blister trays 12 may be used in the same fashion.

Figure 6:
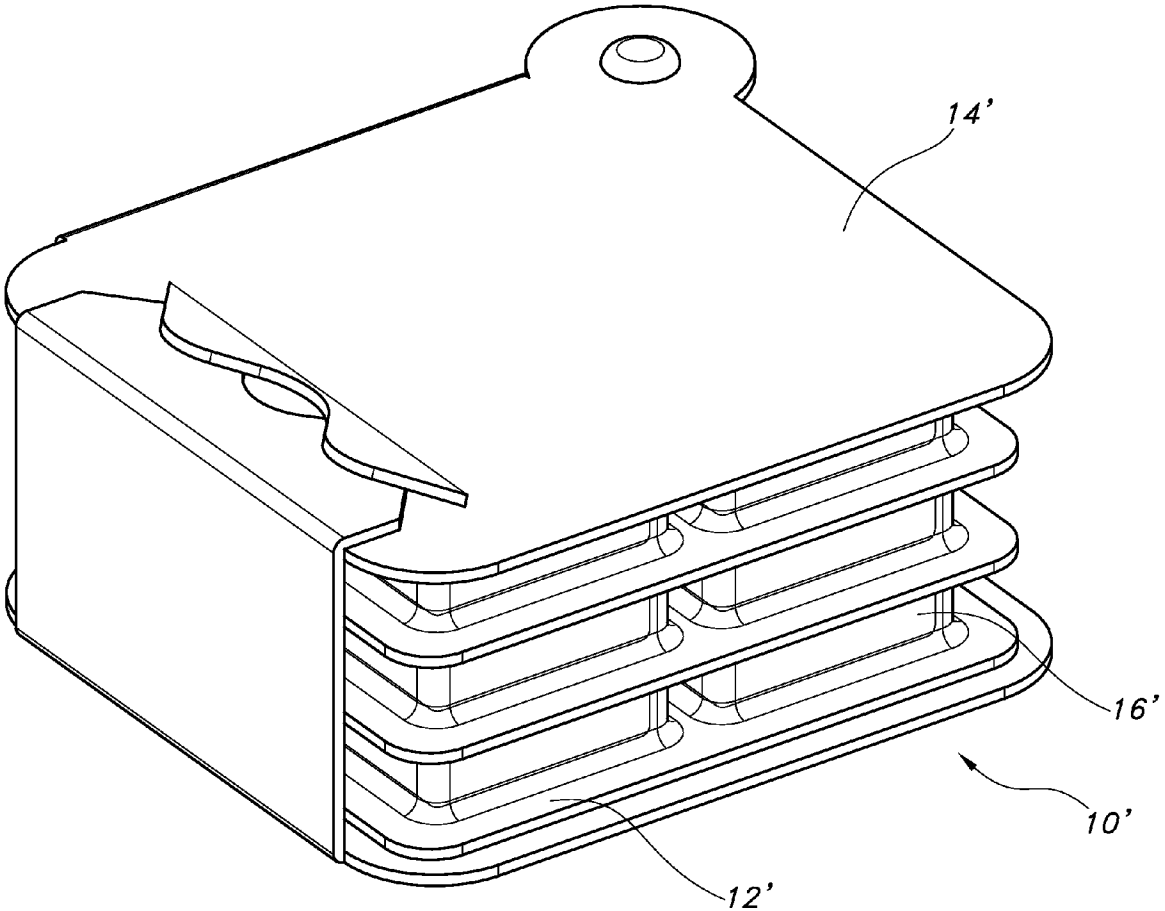
FIG. 6 is a top perspective view of an alternative embodiment of a blister package shown in a closed position.
Figure 7:
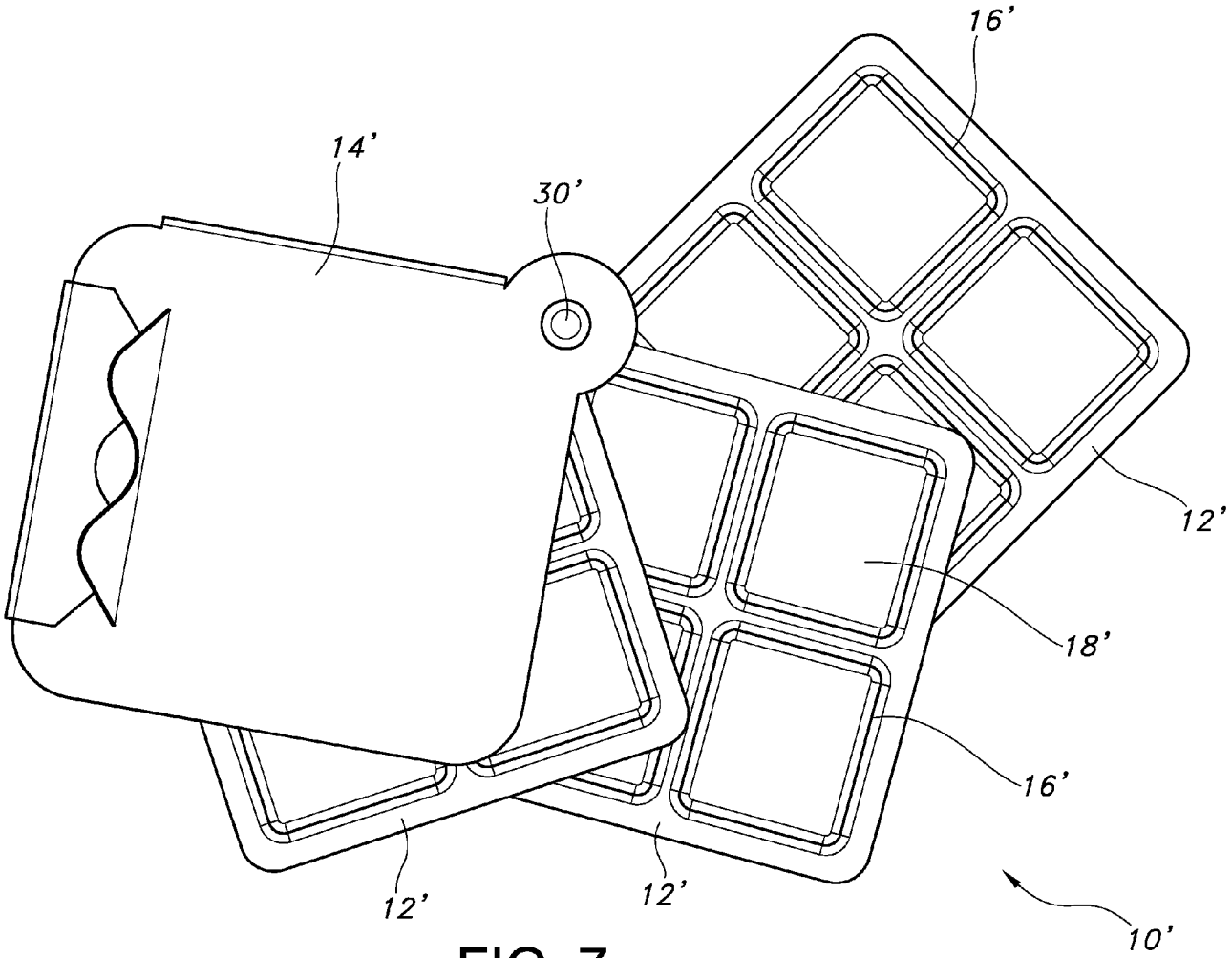
FIG. 7 is top plan view of the blister package of FIG. 6 shown in an open position.

Referring to FIGS. 6-7, a second embodiment of the present invention is shown. This embodiment is substantially similar to the embodiment described with respect to FIGS. 1-5. Blister package 10' includes three blister trays 12' arranged in stacked orientation within blister sleeve 14'. Each tray has a plurality of blister depressions 16' each holding a gum piece 18'. The blister trays 12' may be used in the manner as disclosed above. The trays 12' pivot about pivot pin 30' between a closed and open position. All the blister trays can be pivoted independently of each other and can fan out in an open position as shown in FIG. 7. Each blister tray may include the same product or each tray may have its own distinct product or product flavor.

As can be appreciated, any number of blister trays may be accommodated within the blister sleeve in accordance with the present invention. Similarly, while each blister tray is shown to have four blister depressions arranged in a two-by-two orientation, the blister trays may include any number or orientation of blister depressions therein.

Various changes to the foregoing described and shown structures would now be evident to those skilled in the art. Accordingly, the particularly disclosed scope of the invention is set forth in the following claims.

What is claimed is:

1. A blister package assembly comprising:

at least one blister tray having a plurality of upwardly opening blister depressions, each blister depression accommodating a consumable product, the at least one blister tray including an extending portion projecting outwardly from a corner of the blister tray, the extending portion having in an aperture therethrough;

a blister sleeve having a pair of spaced apart planar walls, wherein the sleeve includes two adjacent edges which are joined to each other and closed to restrict movement of the at least one blister tray, the first and second planar walls including lobes extending outwardly from a corner thereof, the lobes including hinge openings formed therein;

a hinge member extending between the hinge openings and the blister tray aperture for pivotally connecting the blister tray to the sleeve; and said blister tray being received between said walls of said sleeve and pivotable between an enclosed position wherein the blister tray is disposed between said two planar walls and an open position wherein the blister tray extends outwardly from said planar walls.

2. The package assembly as defined in claim 1, wherein the blister depressions are covered by the sleeve when the blister tray is in the enclosed position and the blister depressions are uncovered when the blister tray is in the open position.

3. The package assembly as defined in claim 1, wherein the at least one blister tray includes a plurality of blister trays.

4. The package assembly as defined in claim 3, wherein each of the plurality of blister trays is independently pivotal relative to each other.

5. The package assembly as defined in claim 1, wherein the at least one blister tray includes an extending portion, the extending portion cooperating with a pivot pin for pivotally connecting the blister tray to the sleeve.

6. The package assembly as defined in claim 1, wherein the sleeve includes two adjacent edges which are open into a sleeve interior formed by the planar walls.

7. The package assembly as defined in claim 1, wherein the plurality of blister trays are stacked one on top of the other when the plurality of trays are in the enclosed position.

8. The package assembly as defined in claim 1 wherein the sleeve is formed from a single unitary blank.

9. The package assembly as defined in claim 1, wherein the hinge member includes a pin which extends between the pair of planar walls.

10. Comestible product packaging comprising:

a sleeve including a first and second spaced planar walls defining a sleeve interior the first and second planar walls being connected along a first edge by a sidewall;

the second planar wall including an end wall extending therefrom, the end wall being folded toward and over the first planar wall and secured thereto, the end wall joining the first and second planar walls along a second edge, the side wall restricting the rotation of the first blister tray;

a first blister tray having a plurality of depressions for retaining a comestible product; and the first blister tray being pivotally joined to the sleeve, the first blister tray having a first position wherein the depressions are disposed outside of the sleeve to permit dispensing of the comestible product, and a second position wherein the depressions are disposed within the sleeve interior.

11. The packaging as defined in claim 10, further including a second blister tray having a plurality of depressions for retaining a comestible product, the second blister tray being pivotally joined to the sleeve.

12. The packaging as defined in claim 11, further including a third blister tray having a plurality of depressions for retaining a comestible product, the third blister tray being pivotally joined to the sleeve, the first, second and third blister trays being pivotable independently of each other.

13. The packaging as defined in claim 10, further including a hinge pin for pivotally connecting the first blister tray to the sleeve.

14. The packaging as defined in claim 13, wherein the first blister tray includes a projecting portion having a aperture therein, the hinge pin extending through the aperture.

15. The packaging as defined in claim 13, wherein the first and second planar walls each include a hinge opening formed therein, and the hinge pin extends into and between the hinge openings.

16. The packaging as defined in claim 15, wherein the first and second planar walls include lobes extending therefrom, and the hinge openings are formed in the lobes.

17. The packaging as defined in claim 10, wherein the blister depressions are formed a generally transparent material to permit the comestible products therein to be viewed.

18. The package assembly as defined in claim 1, wherein the two adjacent edges of the sleeve are open and unconnected to each other substantially along their entire length.

19. The packaging as defined in claim 10, wherein the sleeve is formed form a unitary paperboard blank.

20. The packaging as defined in claim 10, wherein the end wall terminates in a tab and the first planar wall includes a slot therein, and the tab being insertable in the slot and secured therein.

* * * * *